United States Patent [19]

Gibson

[11] Patent Number: 4,542,756

[45] Date of Patent: Sep. 24, 1985

[54] PORTABLE NON-POWERED DISHWASHER

[76] Inventor: James Gibson, Rte. 1, Box 183-B, Eunice, La. 70535

[21] Appl. No.: 663,397

[22] Filed: Oct. 22, 1984

[51] Int. Cl.[4] ..... B08B 3/04

[52] U.S. Cl. ..... 134/177; 134/172

[58] Field of Search ..... 134/129, 144, 167 R, 134/168 R, 172, 175, 176, 177, 178, 179, 198, 199, 200; 239/101, 145, 533.13, 567, 602, DIG. 12

[56] References Cited

U.S. PATENT DOCUMENTS 1,281,493 10/1918 Blanks ..... 134/176

3,293,861 12/1966 Hinde ..... 239/533.13 X

FOREIGN PATENT DOCUMENTS 961805 9/1982 U.S.S.R. ..... 134/167 R

*Primary Examiner*—Philip R. Coe

*Attorney, Agent, or Firm*—Keaty & Keaty

[57] ABSTRACT

A non-powered portable dishwasher, especially suited for insertion within a sink, has an enclosed dish-holding container with a rack for separating dirty dishes and a sealable top member for creating an enclosed washing chamber. Suspended from the top member, vertically descending, intermediate the various dirty dishes to be washed are a plurality of flexible washing bladders. Each of these washing bladders in turn has a series of washing apertures permitting the spray of water. Each of the washing bladders is manifolded to a wash-water manifold, which provides for connecting a continuous flow of hot water to the dishwasher, as well as providing for the addition of soap or detergent. When the dishwasher is assembled, filled with dirty dishes, and a source of hot water is supplied, the individual washing bladders will fill with the supplied water and detergent swelling to a larger size contacting the dishes. As a part of the swelling, the individual spray apertures will open emitting a greater volume of wash-water which in turn causes the bladder to collapse. A combination of the surging of the bladders and the substantially horizontal spray direction of the wash water upon the dirty dishes provides an effective cleaning capability and a mild scrubbing action. The necessity for granulated or abrasive detergents, as found in typical spray dishwashers, is eliminated. The dishwasher is particularly advantageous as a portable dishwasher not requiring electrical power for use in campers, mobile homes, campsites and the like.

1 Claim, 5 Drawing Figures

PORTABLE NON-POWERED DISHWASHER

BACKGROUND OF THE INVENTION

Small semi-automatic dishwashing machines are known in the art. The general construction of such machines comprises an enclosed container for holding the dishes and a spray of wash water. There is some form of internal rack mechanism for suspending the dishes in a position to facilitate their washing. A source of water spray for inpenging water upon the dishes is provided and some form of detergent, usually adapted to provide an abrading effect to facilitate the washing of the dishes in conjunction with the spray of water is introduced.

Thus, for example, Lilly, U.S. Pat. No. 2,896,642, shows an in-sink-mounted dishwasher requiring no electrical power and provided with hot water from a standard hose connected to a sink outlet. Lilly shows a typical rack for supporting the dishes in a position adaptable to their being washed and also disclosed a opposed spray jet nozzles for spraying water upon the dishes to facilitate their washing. As is typical of the art in non-powered dishwashers, Lilly shows fixed-mounted spray heads having a fixed angle of spray upon the dishes. As an alternative, Amer, U.S. Pat. No. 2,670,000, discloses a washer in which an upper and an intermediate spray bar provide an essentially vertical spray which largely is planer to the surface of the dishes to be washed. Bond, U.S. Pat. No. 2,850,025, in an invention disclosing a novel hood arrangement for portable dishwashers discloses an essentially vertical spray from beneath the dishrack. An alternative design Bond, U.S. Pat. No. 2,771,895, discloses both an upper and a lower water spray element, still fixed. In a related art, a diaper washer of Thomas, U.S. Pat. No. 2,697,341, in which a fixed water spray unit provides sufficient force to rotate a turntable containing the objects to be cleaned, in this case diapers, so as to provide a variable water spray. Olson, U.S. Pat. No. 2,038,803, discloses a sink mountable portable dishwasher in which an upper spray head is traversed laterally across the cleaning chamber; again, the general direction of spray is downwards, planer to the surfaces of the dishes to be cleaned.

It is typical of all dishwashers of this particular portable type that, lacking an independent motor or an electric power source, they display an essentially fixed water spray which is dependent upon through the inpenging force of the water to perform all the cleaning on the enclosed dishes within the dishwasher. The use of multiple powered rotary spray head, as is typical on large home or industrial dishwashers, is unfortunately unavailable due to the necessity of having a dishwasher which is both portable, and requires only a source of water for functioning.

It is also unfortunately a constraint of these designs that the water flow essentially is planer along the surface of the dishes to be washes and is essentially a constant unvarying flow during the cleaning cycle, as neither the dishes nor the water is moved.

SUMMARY OF THE INVENTION

The invention discloses a novel, portable dishwasher, requiring only a source of water for its functioning in which an inventive, flexible bladder water dispenser provides both a reciprocating and a scrubbing action against the dishes as well as providing a multi-angled spray, both vertical and horizontal, against the surface of the dishes to be cleaned. The dishwasher comprises basically an enclosed water-tight container with suitable internal provisions for holding an array of dirty dishes and the like in a position for washing. Periodically within the container are suspended a series of flexible expansible bladders having multiple apertures for the spraying of water. The bladders are manifolded to a source of hot water, for the provision of a detergent, which need not be an abrasive detergent. The application of pressurized hot water to the dishwasher causes the individual bladders to expand providing a first scrubbing action upon the dishes. The expansion of the bladders in turn expand the individual spray apertures, causing a rapid outflush of water and a consequent collapse affect upon the sides of the bladders. The collapsed affect in turn causes the spray aperture to decrease in size, decreasing the flow of water and expanding the bladder. The repeating cycle of expansion, spray burst and collapse provides both a mechanical scrubbing affect by the movement of the bladders as well as a pulsating, multi-directional water affect upon the dishes. It is found that this combination provides for a much more efficient cleaning cycle and a much greater effectiveness in cleaning dishes than the portable dishwashers of the prior art.

It is thus an object of this invention to provide a portable dishwasher which requires only the supply of pressurized hot water for functioning.

It is a further object of this invention to provide a dishwasher particularly adaptable for use in remote locations, campers, mobile homes, and the like.

It is a further object of this invention to provide a non-powered portable dishwasher having a particular advantageous cleaning capability.

It is a further object of this invention to provide a non-powered portable dishwasher which provides a pulsating scrubbing spray affect for the cleaning of dishes.

This and other objects of the invention are more clearly ascertained from the detailed description of the preferred embodiment and the claims.

DETAILED DESCRIPTION OF THE PREFERRED EMBODIMENT

Figure 1:
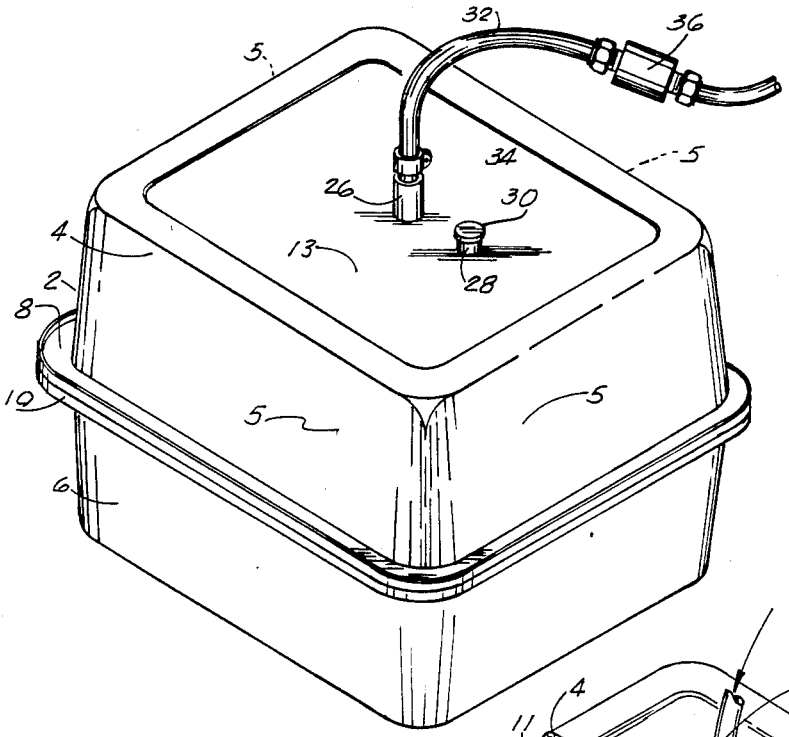
FIG. 1 is an angled view of the dishwasher as assembled suitable for insertion in a sink.
Figure 2:
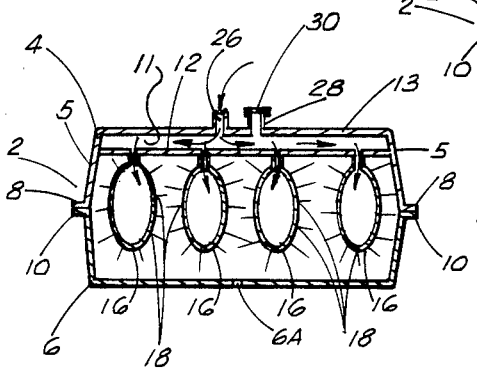
FIG. 2 is a side cutaway view of the inventive dishwasher showing the manifold flow of clean water through the inventive bladders.
Figure 3:
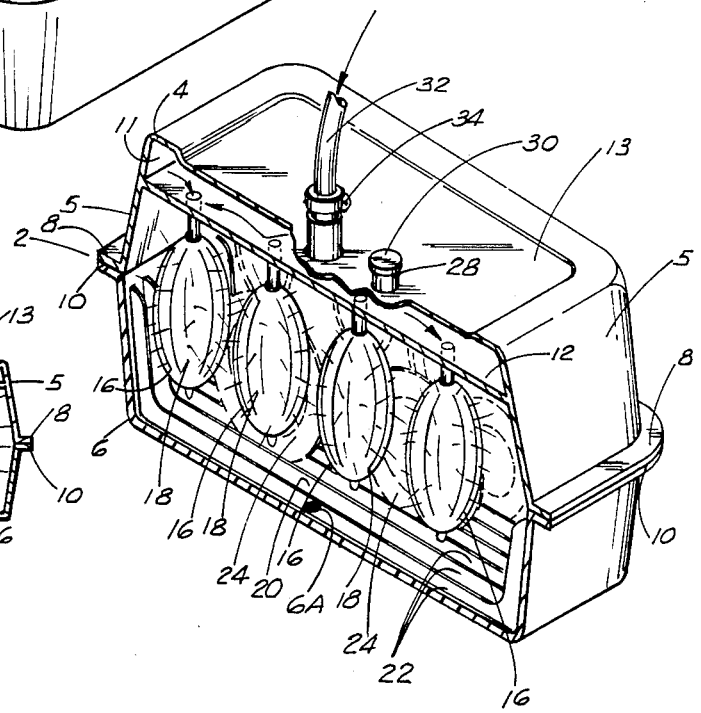
FIG. 3 is a section view of the dishwasher in operation showing the relative arrangement of the bladders, the water flow, and the dishes to be cleaned.
Figure 4:
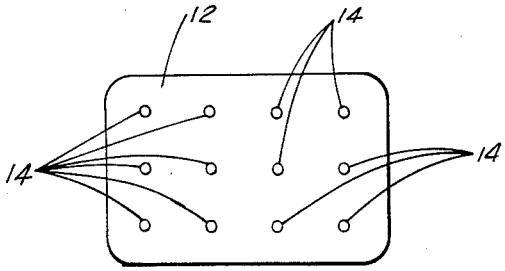
FIG. 4 is a top view of the manifold plate of the invention showing a typical arrangement of the bladders.

Referring to FIGS. 1 through 3, the overall inventive dishwasher assembly 2 is seen to comprise two major sub-sections. An upper lid section 4 and a base section 6. Upper lid 4 is a substantially rectangular box section having a closed top and sides and an open bottom. Each of the sides 5 of the upper lid 4 terminate in a continuous upper lid flange 8 which extends about the perimeter of the open end of the upper lid. A corresponding lower lid flange 10 extends around the upper periphre of the base section section 6, which in turn is a substantially rectangular open dish having a closed bottom and sides, opening upwards. As seen in FIG. 1, upper lid flange 8 and lower lid flange 10 are constructed so that they are adapted to be joined together in face to face mating arrangement by any clamping means such as clips. Due to the relatively low water pressure generated within the closed assemblage of the upper lid for the base section 6, any claimping method capable of exerting a moderate amount of pressure closing upper lid flange 8 and lower lid flange 10 will produce a substantially watertight closure.

Upper lid 4 is divided into two chambers by lid flowplate 12, which extends in sealing relationship between each of the sides 5 of upper lid 4, parallel to upper lid top 13, spaced a distance within upper lid 4 from top plate 13. Lid flowplate 12 is sealingly attached to the sides 5 of upper lid 4 and is provided with a plurality of elongated water flow passages 14.

To each of the water flow passages 14 of lid plate 12 is attached a flexigle spray bladder 16, suspended in fluid connecting, hanging relationship to lid flowplate 12. Each of the spray bladders 16 in turn has a plurality of spray bladder orifices 18; the spray bladder orifices 18 in the preferred embodiment are small holes or slits spaced about the spray bladder 16.

In spaced array within base sections 6 is provided dish holder 20. In the embodiment of the invention illustrated in FIG. 3 dish holder 20 comprises a plurality of dish holder lips 22 which are elongated ridges molded into or adhesively attached to the walls and bottom of the interior of base sections 6. Dish holder lips 22 are substantially thin arising ridge sections adapted to gripping and supporting dishes 24 by frictional engagement to the edges thereof.

At a point in top plate 13 of upper lid 4 is provided water inlet 26, providing fluid connection for flow to within the chamber defined by and between upper top plate 13 and lid flow plate 12. Also provided in top plate 13 is a detergent inlet 28 adapted to be opened and closed by detergent plug 30. Detergent plug 30 may be removed from detergent inlet 28, permitting the pouring insertion of detergent to within inner chamber 11.

Figure 5:
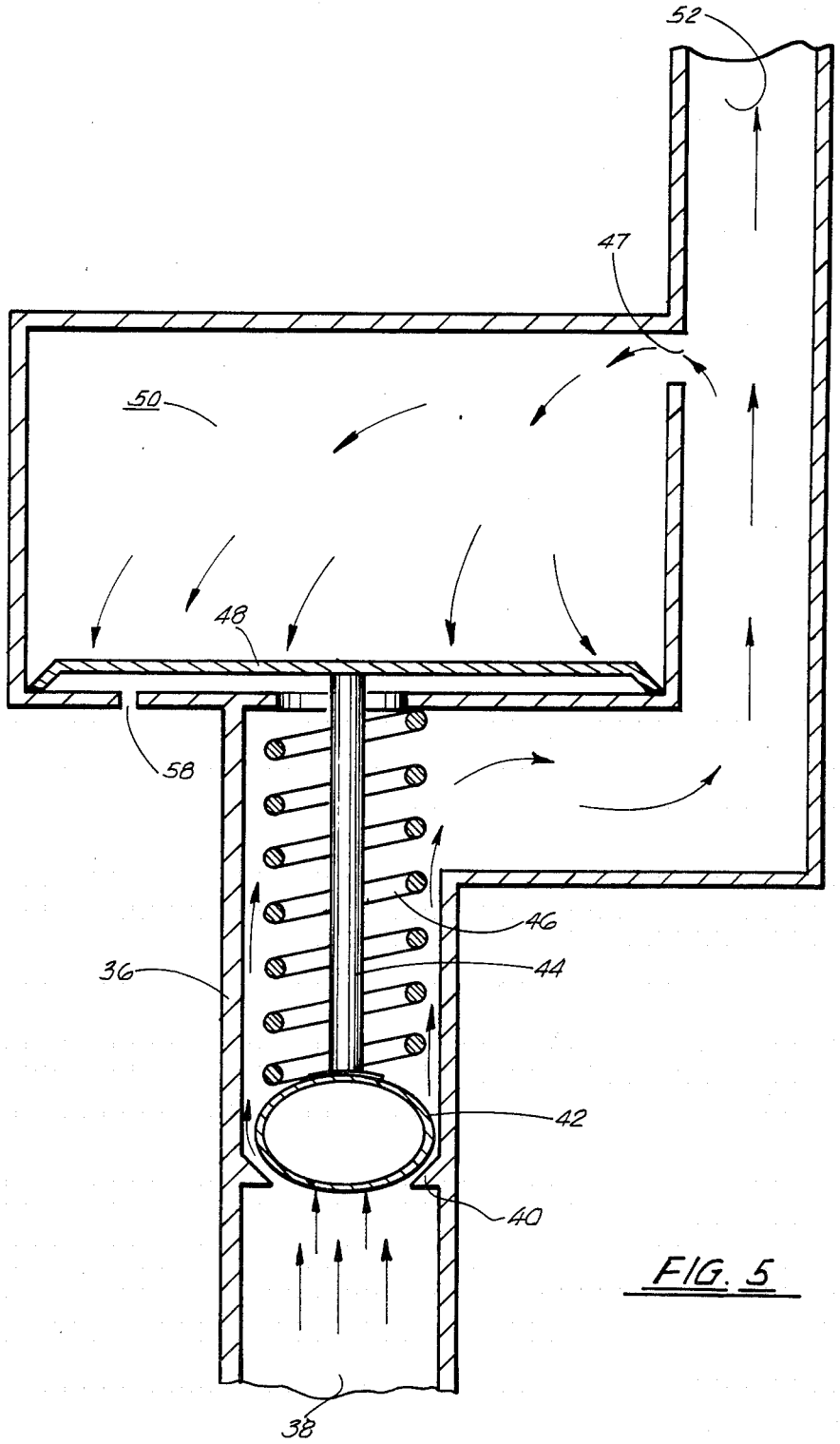
FIG. 5 is a cutaway schematic view of the pulse valve of the invention.

Water inlet 26 is in turn connected to a water supply hose 32; hose 32 is secured to inlet 36 by means such as a hose clamp 34. Inserted within and in line to water supply hose 32 is pulse valve means 36. As shown in FIG. 5, pulse valve means 36 in one embodiment of the invention comprises an inline flow valve having an inlet passage 38, fluidly connected to a water supply hose for the supplying of water. In fluid connection inlet passage 38 is a valve comprising a valve seat 40 and a sealing valve ball 42. Valve ball 42 is positioned by the positioning of a drive shaft 44 biased into a closed position by bias spring 46. An innerflow passage 47 is fluidly connected through the valve formed by ball 42 and seat 40 with inlet passage 38 and in turn fluidly connects to a pulse valve diaphram chamber 50 and a pulse valve outlet 52. Pulse valve diaphram chamber 50 in turn is in fluid pressure connection to a pulse valve drive diaphram 48, connected in actuating relationship to drive shaft 44. Pulse valve outlet 52 in turn is in fluid connection with water supply inlet hose 32. Water supply inlet hose 32A, fluidly connected to pulse valve outlet passage 38, is in turn connected to any pressurized source of water.

In operation, dishwasher assembly 2 is placed within a sink or similar facility having the capability of draining off water. Water inlet supply hose 32A is connected to a pressurized source of wash water. Dishes are placed within dish holder 30 and upper lid section 4 is placed over base section 6, fastened thereto by the clamping together of upper lid flange to lower lid flange 10. Detergent cap 30 is removed, and a quantity of detergent inserted through detergent inlet 28, falling thereby into inner chamber 11. Pressurized water is supplied through water inlet supply hose 32. The initial flow of water against valve ball 42 forces valve ball 42 open against the biased force of spring 46. Water then flows through inlet flow passage 47; the majority of the water flows out of valve outlet 52 into inlet supply hose 32. However, a quantity of water flows into diaphram chamber 50 against drive diaphram 48. The greater force generated upon the larger surface of drive diaphragm 48 overcomes the pressure on ball 42 and, aided by bias spring 46 closes ball 42 against seat 40 shutting off the flow of water. The action, to be described hereafter, dishwasher assembly 2 drains the water from valve outlet 52 and diphragm chamber 50, reducing the pressure on drive diaphragm 48, permitting bias spring 46 to react and be overcome by the pressure on ball 42 from inlet passes 38, repeating the cycle. The above described pulse valve functioniong is a suggested embodiment of the inventor, and any valve assembly or apparatus producing a pulsing flow of water may be equally substituted therefor. The pulse valve does not constitute a portion of the invention other than its insertion within the inlet water line 32 is considered to aid the functioning of the dishwasher 2.

The supply of water provided through inlet 32 fills chamber 15 and then flows through passages 14, which are the only opening provided for flow to chamber 11. The pressurized water, either steady state or pulsed, fills spray bladder 16. Spray bladder 16 are suspended bladder members having a substantial expansion capability. Bladder 16 will swell under the force of the water pressure and this swelling will, in turn, stretch the surfaces of spray bladder 16 causing a corresponding opening of orifices 18 in the flexible bladder member. The swelling action of the spray bladder 16 provides a scrubbing effect against dishes 24. Simultaneously, the stretched opening of the orifices 18 provides an increased flow of liquid out of the inner chamber 11.

Since a measured quantity of detergent was placed, as stated previously, in chamber 11 prior to the activation of dishwasher assembly 2, the initial washwater provided through the bladder orifices 18 will be a detergent water mixture particularly adapted to the emulsification or removal of soils on dishes 24.

The water flows and is sprayed on dishes 24. It naturally descends on dishes 24 to within the base of base section 6 and flows then through drain 60 in base section 6 into the surrounding sink or similar apparatus and thence is disposed of.

As water continues to be supplied to inlet 32 the quantity of detergent in chamber 11 is gradually diminished and eliminated. At this point the continued activation, swelling and spraying of spray bladder 16 is now of a substantially clear rinse water. The action of spray bladder 16 continues to scrub and spray dishes 24 with clear water, rinsing the detergent. Again, the water collects in bay section 6 and is drained through drain 60 and being removed from dishes 24.

While the oscilating the swelling, spraying and collapsing of bladder 16 provides an essential scrubbing action on dishes 24, it is to be seen that this action could be aided by pulsing the inlet flow of water for which reason pulse valve assembly 36 is provided. However, it has been found in practice that even absent pulse valve 36, the expansion of the spray bladder orifices 18 upon expansion of the spray bladder 16 so increases the flow of water through the spray bladder 16 as to exceed the amount of water being input into chamber 11 through water inlet 26. This in turn rapidly evacuates chamber 11 of water producing a signficant diminuation of water pressure and a consequent collapse of spray bladders 16. As a result, it has been determined that even absent a pulse valve 36, the dishwater assembly 2 as described functions over a wide range of inlet flow pressures.

It is a material part of the invention that it has been discovered that the pulsing effect of the bladders together with the pulsing spray that is produced by the bladders provides a significant cleaning action on dishes 24 without the use of other moving mechanical devices or high pressure sprays. It is to be noted that the desired dishwasher assembly 2 functions without any input power other than the pressure of the water provided through inlet 26. The described dishwasher assembly 2 is therefore particularly adapted to field operations and installation in such vehicles as campers, mobile homes and the like where the provision of significant electrical power may be limited.

It can thus be seen that the desribed dishwasher assembly 2 is susceptible of many physical embodiments which incorporate the primary features of the invention and that the described embodiment is only one known preferred working version and represents the current best version known to the inventor.

The invention therefore encompasses those equivalents which can be seen from the claims, and is not restricted to the specific embodiment described herein.

I claim:

1. A non-powered portable dishwasher comprising:

A. a substantially deep bottom base member adapted for supporting an array of dishes to be washed;

B. a lid member adapted to sealingly enclose said dishes within said bottom base member;

C. means for supplying a flow of water under pressure fluidly connected to said dishwasher; and D. a plurality of bladder members having expansion capability supported intermediate said dishes, fluidly connected to said water, having perforations therein, said bladder members arranged, when expanded, to simultaneously contact the dishes and spray water onto the dishes through said perforations to scrub and wash the dishes.

* * * * *